US006848866B1

(12) United States Patent
McGinn

(10) Patent No.: US 6,848,866 B1
(45) Date of Patent: Feb. 1, 2005

(54) SEDIMENT CONTROL

(76) Inventor: John H. McGinn, 69 Maple Dr., Sacramento, CA (US) 95823

( * ) Notice: Subject to any disclaimer, the term of this patent is extended or adjusted under 35 U.S.C. 154(b) by 0 days.

(21) Appl. No.: 10/742,076

(22) Filed: Dec. 19, 2003

(51) Int. Cl.[7] ..... E02B 3/00; E02D 17/20; B32B 19/00; D04H 5/00

(52) U.S. Cl. ..... 405/302.6; 405/15; 405/19; 405/32; 405/302.7; 210/170; 210/747; 442/327; 428/357

(58) Field of Search ..... 405/15, 16, 19, 405/32, 302.4, 302.6, 302.7; 210/170, 747; 442/361, 366, 367, 327; 428/357, 372

(56) References Cited

U.S. PATENT DOCUMENTS

| | | | | |
|---|---|---|---|---|
| 3,455,112 A | | 7/1969 | Twele | 405/19 |
| 4,854,773 A | | 8/1989 | Nicoll | 405/15 |
| 5,108,224 A | | 4/1992 | Cabaniss et al. | 405/52 |
| 5,257,878 A | | 11/1993 | Peterson | 405/15 |
| 5,338,131 A | | 8/1994 | Bestmann | 405/24 |
| 5,575,584 A | | 11/1996 | Alsop | 405/24 |
| 5,733,825 A | * | 3/1998 | Martin et al. | 428/372 |
| 5,954,451 A | * | 9/1999 | Presby | 405/49 |
| 6,277,473 B1 | | 8/2001 | McGinn | 428/188 |
| 6,332,737 B1 | | 12/2001 | Mattson | 405/63 |
| 6,422,787 B1 | | 7/2002 | Mikell | 405/15 |
| 6,497,532 B1 | | 12/2002 | McGinn | 405/27 |
| 6,505,996 B1 | * | 1/2003 | Ianniello et al. | 405/36 |
| 6,547,493 B2 | | 4/2003 | Spangler et al. | 405/302.6 |
| 6,641,335 B1 | | 11/2003 | Allard | 405/302.6 |
| 6,733,209 B2 | * | 5/2004 | Allard | 405/302.6 |
| 2003/0143026 A1 | * | 7/2003 | Santha | 405/15 |

FOREIGN PATENT DOCUMENTS

| | | | |
|---|---|---|---|
| GB | 2171131 | * | 8/1986 |

* cited by examiner

*Primary Examiner*—Jong-Suk (James) Lee
(74) *Attorney, Agent, or Firm*—T.H. P. Richardson

(57) ABSTRACT

A sediment control roll includes a threshold member having large apertures therethrough, a hollow sediment collection chamber, and an outflow filter having small apertures therethrough. The sediment control roll can be used to collect sediment in runoff from a construction site, or to reduce removal of sediment from an existing mass of soil, sand or other sediment. The sediment control roll can for example be made by rolling up extruded polymeric netting with filter cloth attached thereto.

26 Claims, 3 Drawing Sheets

SEDIMENT CONTROL

BACKGROUND OF THE INVENTION

This invention relates to the control of sediment. The term "sediment" is used herein to denote solid particulate material, e.g. soil, sand or pebbles, which can become suspended, or which is suspended, in a flowing stream of liquid, and which will settle out of the liquid when the liquid ceases to flow. The term "sediment control roll" is used herein to denote an article which can be transported and placed (i) on top of a substrate, usually the ground, in order to collect sediment from a sediment-bearing stream of liquid, usually water, which passes through the sediment control roll, or (ii) around an existing mass of soil, sand or other sediment, e.g. a river bank or a beach, in order to prevent or reduce removal of the soil, sand or other sediment by water flowing towards, over or through the mass of soil, sand or other sediment.

It is often desirable, and sometimes legally required, to collect sediment from liquid in which it is suspended, or to stabilize an existing mass of sediment to prevent it from being carried away. For example, in some cases, the law requires removal of sediment from liquid flowing out of a construction site. Often, there is neither time nor space to collect suspended sediment merely by placing the sediment-bearing liquid in a pond and allowing the sediment to settle. The conventional method for collecting sediment is to place hay bales or wattles across the path of the liquid. More recent methods are described in, for example, U.S. Pat. Nos. 6,422,787, 6,547,493 and 6,641,335, the disclosures of which are incorporated herein by reference. These known methods make use of large masses of water-absorbent materials which are secured to each other and/or held together by binders. The water-absorbent materials retain sediment and absorb large quantities of water until they are saturated. This makes them heavy, so that they are difficult or impossible to reuse and/or recycle. In many cases, they are left in place to form part of the landscape.

SUMMARY OF THE INVENTION

I have realized, in accordance with the present invention, that sediment can be effectively collected by directing a sediment-bearing liquid successively through (a) a threshold member which has a plurality of relatively large apertures therethrough and which reduces the speed of the sediment-bearing liquid, (b) a substantially hollow sediment collection chamber, and (c) an outflow filter having a plurality of relatively small apertures therethrough.

In some embodiments of the invention, the purpose in collecting the sediment is to prevent it from being deposited at undesirable locations. In other embodiments, the purpose is to prevent an existing mass of soil, sand or other sediment from being carried away.

The threshold member, collection chamber, and outflow filter are conveniently combined together as a sediment control roll. Often, because filter materials do not generally have sufficient physical strength to be self-supporting under normal usage conditions, the outflow filter is supported by an outflow member which has a plurality of relatively large apertures therethrough and through which the liquid passes after it has passed through the outflow filter. In some embodiments, at least some of the sediment-bearing liquid, after it has passed through the threshold member and before it passes through the sediment collection chamber, passes through a threshold filter having a plurality of relatively small apertures therethrough, for example a threshold filter which is supported by, e.g. secured to the inside of, the threshold member.

The sediment collection chamber is "substantially hollow", the term "substantially hollow" being used herein to mean that the sediment collection chamber has an unobstructed volume which is at least 50%, e.g. 50 to 98%, particularly at least 70%, e.g. 70 to 97%, for example at least 80%, e.g. 80 to 96%, of the total volume of the sediment control roll. For example, in one embodiment, an outflow filter is secured inside the outflow member (for example is sandwiched between the outflow member and an interior layer of the same or similar material having relatively large apertures therethrough) and optionally a threshold filter is secured inside the threshold member (for example is sandwiched between the threshold member and an interior layer of the same or similar material having relatively large apertures therethrough), and the volume between the threshold and outflow members is otherwise empty. Alternatively (provided that the sediment collection chamber remains "substantially hollow" as defined above), there can for example be additional members which occupy some of the space between the threshold and outflow members. Such additional members may or may not have a substantial effect on the flow of liquid through the sediment collection chamber.

As further discussed below, preferred embodiments of the present invention provide sediment control rolls which, after each use, can be removed, cleaned and reused, and which, after repeated use, can be recycled.

In a first preferred aspect, this invention provides a sediment control roll which comprises 1) an elongate threshold member having a plurality of relatively large threshold apertures therethrough;

2) an elongate outflow member having a plurality of relatively large outflow apertures therethrough;

3) an elongate outflow filter which
   (i) is supported by, e.g. secured to, the outflow member and
   (ii) has a plurality of relatively small filter apertures therethrough;

the sediment control roll comprising a substantially hollow, elongate sediment collection chamber which lies between the threshold member and the outflow member.

In one embodiment of the first aspect of the invention, the sediment control roll comprises a) a single piece of an apertured polymeric sheet which has been shaped into a generally tubular configuration comprising overlapping layers of the apertured polymeric sheet (e.g. rolled up into a generally cylindrical shape), and b) a sheet of filter material which is secured between the overlapping layers of the apertured polymeric sheet.

In this embodiment, the apertured polymeric sheet provides the threshold and outflow members; and the sheet of filter material provides the outflow filter, and, if present, the threshold filter.

In a second preferred aspect, this invention provides a method of collecting sediment from a flowing stream of a sediment-bearing liquid which comprises (A) passing the flowing stream through a threshold member having a plurality of relatively large threshold apertures which pass through the threshold member and whose size is such that (i) the speed of the flowing stream is substantially reduced and (ii) at least a substantial proportion, preferably all, of the sediment can pass through the threshold member;

(B) passing the liquid stream from step (A) through a substantially unobstructed sediment collection chamber; and (C) passing the liquid stream from step (B) through an outflow filter having a plurality of relatively small filter apertures which pass through the filter and whose size is such that at least a substantial proportion of the sediment cannot pass through the filter.

Often, because filter materials do not generally have sufficient physical strength to be self-supporting under normal usage conditions, the method also includes the step of (D) passing the liquid stream from step (C) through an outflow member which supports the outflow filter and which has a plurality of relatively large outflow apertures passing through it.

In a preferred embodiment of the second aspect of the invention, the sediment-bearing liquid is passed through a sediment control roll as defined in the first aspect of the invention.

In one preferred embodiment of this aspect of the invention, the flowing stream is run-off from a construction site. In another preferred embodiment of this aspect of the invention, the flowing stream comes from an existing mass of soil, sand or other sediment, and the method prevents or reduces removal of sediment from that existing mass of soil, sand or other sediment.

In a third preferred aspect, the invention provides a method of making a sediment control roll, preferably a sediment control roll according to the first preferred aspect of the invention, the method comprising (A) providing an apertured sheet material having relatively large apertures therethrough;

(B) securing a sheet of filter material having relatively small apertures therethrough to part or all of the apertured sheet material; and (C) shaping, e.g. rolling up, the apertured sheet having the filter material secured thereto, to provide a generally tubular body comprising an elongate member comprising the filter material sandwiched between first and second parts of the apertured sheet material.

BRIEF DESCRIPTION OF THE DRAWINGS

The invention is illustrated in the accompanying drawings, which are diagrammatic sketches and are not to scale, and in which.

DETAILED DESCRIPTION OF THE INVENTION

Figure 1:
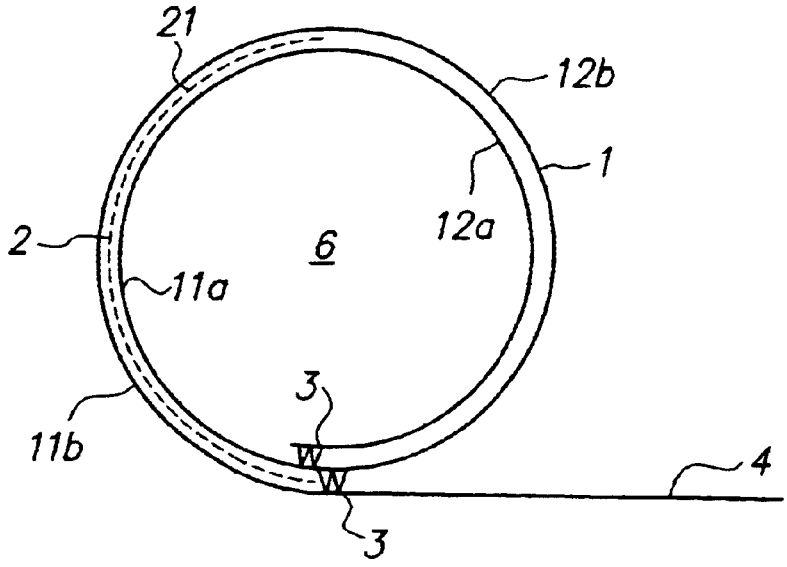
FIGS. 1–3 are cross-sections through sediment control rolls of the invention.

In the Summary of the Invention above and in the Detailed Description of the Invention and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, or a particular drawing, that feature can also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can contain only components A, B and C, or can contain not only components A, B and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility. The term "at least" followed by a number is used herein to denote the start of a range beginning with that number (which may be a range having an upper limit or no upper limit, depending on the variable being defined). For example "at least 1" means 1 or more than 1, and "at least 80%" means 80% or more than 80%. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)", this means a range whose lower limit is the first number and whose upper limit is the second number. The numbers given herein should be construed with the latitude appropriate to their context and expression.

Threshold Members

The apertures in the threshold member (the "relatively large threshold apertures") have a size such that (i) the speed of liquid directed at the threshold member is substantially reduced, and (ii) at least a large proportion, preferably all, of the sediment can pass through the threshold member. The threshold member is preferably the first class of the sediment control roll which opposes the flow of the sediment-bearing liquid. Often all the apertures have the same size and/or shape, though this is not necessary. The apertures can be of any shape, for example polygonal, including triangular and parallelogrammatic (including rectangular, e.g. square), round or oval. In some embodiments, each of the apertures is in the shape of a parallelogram in which the acute angles are from 60 to 82°, preferably 70 to 80°. Each of the apertures can for example have an area of 0.01 to 1.0, preferably 0.02 to 0.25, particularly 0.03 to 0.16, e.g. 0.04 to 0.1, $in^2$, and/or a minimum dimension of 0.1 to 1.0, preferably 0.15 to 0.5, particularly 0.15 to 0.4, e.g. 0.2 to 0.3, in. Such apertures provide little or no resistance to many of the sedimentary particles generally encountered in practice, but prevent the passage of larger objects floating on the liquid, for example sticks, cans and plastic bottles.

The greater the ratio of solid surface area to the total area of the threshold member, the more the threshold member will slow down the stream of sediment-bearing liquid. This reduction in the speed of the stream of liquid is accompanied by deflection of the sediment-bearing liquid in many directions. Both factors enhance removal of sediment from the liquid which has passed through the threshold member. However, if the stream is slowed too much, it may not all be able to pass through the threshold member, and as a result some of the sediment-bearing liquid may flow over the top of the threshold member without any sediment being removed therefrom. In some embodiments of the invention, the solid surface area of the threshold member is 10 to 80%, for example 25 to 65%, of the total area of the exposed surface of the threshold member, both areas being viewed at right angles to the threshold member.

The threshold member can be composed of a plurality of strands, e.g. polymeric strands, connected together at junction points, thus providing a solid network, against and through which the sediment-bearing liquid flows. The thickness of the polymeric strands, viewed at right angles to the plane of the threshold member, can for example be 0.08 to 0.3 in., e.g. 0.1 to 0.2 in. Thus, materials suitable for use as the threshold member can be in the form of the heavier grades of netting obtained by melt-extruding an organic polymer. Methods for producing such netting are well-known, and may for example make use of two rapidly rotating, opposed extrusion heads, each set to extrude polymeric strands at the same angle to the principal axis of the resulting product, i.e. the machine direction. The resulting netting comprises generally parallelogram-shaped apertures defined by (i) a plurality of first strands which are parallel to each other and (ii) a plurality of second strands which are parallel to each other, the first strands and second strands being at the same angle to the principal axis of the netting. Especially when preparation of the sediment control roll includes rolling, or otherwise shaping, a length of such netting to provide the threshold member, and/or the outflow member, the acute angle between the first and second strands is preferably 60 to 82°, for example 70 to 80°. Preparation of such netting requires modification of the well-known techniques for preparing extruded netting, but those skilled in the art will have no difficulty, having regard to their own knowledge and the disclosure of this specification, in preparing such netting. The netting is preferably rolled (or otherwise shaped) so that the machine direction of the netting runs transversely around the resulting roll.

The threshold member is preferably composed of a polymeric composition (i.e. a composition containing a polymer and conventional additives such as fillers) which can be melt shaped, particularly a composition which does not absorb substantial amounts of water in use and/or which can be recycled and/or which is resistant to ultraviolet light, e.g. through the inclusion of 2–3% by weight of carbon black. Suitable polymers for the composition include polyolefins, particularly high density polyethylene and polypropylene. The polymer, in part or all of the threshold member, can be cross-linked, for example by exposure to electron beam radiation It is preferable to avoid the use of polymeric compositions which can decompose, or release materials harmful to the environment, including wildlife, for example polymers containing plasticizers. Other materials that can be used for the threshold member are suitably apertured metal sheets, and interconnected metal wires, optionally coated with synthetic polymers.

When the threshold member is made up of two (or more) overlapping layers of the same (or different) apertured material, the effect of the threshold member on the stream of sediment-bearing liquid will depend upon the extent to which the strands defining the apertures overlap. If the apertures are all the same size and are directly on top of each other, the effective size of the apertures and the solid surface area of the threshold member of the two layers will be much the same as for only one of the layers. On the other hand, if the solid strands defining the apertures are staggered, the effective size of the apertures will be reduced, for example by 30–50% and the solid surface area will be increased, for example by 30–50%.

Outflow Members

The description above of threshold members is also applicable to outflow members. In many cases, the outflow and threshold members are provided by a single piece of suitable apertured material which is cut and shaped to provide the desired relationship between the two members and the rest of the sediment control roll. However, the outflow and threshold members can be separate pieces of the same apertured material, or separate pieces of different apertured materials.

The outflow member is preferably composed of a material which is the same as the threshold member and the filter(s), or which can be recycled in the same batch as the threshold member and filter(s).

The threshold and outflow members are preferably composed of materials, and have dimensions, such that the sediment control roll has adequate strength, toughness and flexibility, without the need for additional support members. High density polyethylene offers a good balance between strength, flexibility, toughness, stability, cost, availability, ease of recyclability, and environmental acceptability. Other satisfactory polymers include polypropylene and low density polyethylene.

Filters

The outflow filter is contacted by the sediment-bearing liquid after the sediment-bearing liquid has passed through the threshold member and the sediment collection chamber, and before it passes through the outflow member. In some embodiments, there is also a threshold filter which is contacted by the sediment-bearing liquid before it passes through the sediment collection chamber. When there is both an outflow filter and a threshold filter, they may be composed of the same or different filter materials. For example, the size of the apertures in the outflow filter can be smaller than the size of the apertures in the threshold filter.

If there is a threshold filter, some of the sediment entrained by the liquid drops down in front of, or is retained in, the threshold filter. The sediment which passes through the threshold member (and through or over the threshold filter, if present) precipitates in the substantially hollow sediment control member either as a result of the reduction in the speed and/or change in direction of the liquid, or because it cannot pass through the outflow filter, and therefore drops down in front of, or is retained in, the outflow filter.

The outflow filter preferably extends over substantially all of the outflow member so that the capacity of the sediment collection chamber is as large as possible. However, this is not necessary. For example, the outflow filter can extend over only a lower section of the outflow member, the lower section extending from the bottom of the outflow member to an upper level which is at least 50%, e.g. 58 to 90%, preferably at least 70%, e.g. 70 to 90%, of the height of the sediment control roll.

The threshold filter, if present, can extend over substantially all of the threshold member, or can extend over only a lower section of the threshold member, the lower section extending from the bottom of the threshold member to an upper level which is at least 20%, e.g. 20 to 90%, or at least 35%, e.g. 35 to 80%, or at least 60%, e.g. 60 to 90%, of the height of the sediment control roll. The top of the threshold filter, if present, may be at a lower level than the top of the outflow filter. For example, the top of the outflow filter maybe higher by at least 10%, preferably by at least 30%, of the height of the sediment collection chamber. In another embodiment, there is a section at the top of the sediment roll which is free from filter material.

In use of sediment control rolls having a threshold filter, sediment will initially be deposited in front of the threshold filter, but as time goes on and sediment is deposited in front of the roll (or if there is a sudden surge of the sediment-bearing liquid), the sediment-bearing liquid may flow over the top of the threshold filter, directly into the sediment collection chamber, thus depositing further sediment within the sediment collection chamber.

If the characteristics of the sediment-containing liquid can be predicted, then the characteristics, including but not limited to the mesh size, of the outflow filter (and of the threshold filter if present) can be selected accordingly. In general, the filter layer(s) have a mesh size (measured by ASTM E-11) of 80 to 600 micron, preferably 100 to 500 micron, e.g. about 100 micron. Such filters are commercially available. The filter material can for example be sheet material having a substantially uniform thickness of less than 0.5 in. or less than 0.25 in., for example 0.01–0.06, preferably 0.01–0.04, e.g. 0.013–0.028 inch.

In tests in which clean water is passed through the filter material, on its own, the filter material, depending on its mesh size, is generally capable of passing at least 100, e.g. at least 200, gallons of water per square foot per minute, but not more than 600, e.g. not more than 400, gallons of water per square foot per minute.

Filter materials used in the present invention may need to be supported so that they are not displaced by the flowing liquid. In some embodiments, the filter material is secured to the outflow member or the threshold member. Alternatively or additionally, the threshold filter or the outflow filter may be secured to an interior support member.

The interior support member can for example be an apertured polymeric sheet which is the same as the outflow member and/or the threshold member, or which has apertures larger than those in the outflow member and/or the threshold member. When the compositions of the threshold and outflow members and of the filter(s) and of the interior support member(s) if present, are such that they can be melt-bonded together (for example when they are composed of the same organic polymer), they are preferably secured to each other by melt bonding, for example along discrete lines or at discrete spots.

The filter(s) is(are) preferably composed of a synthetic polymer, particularly a polymer which does not absorb substantial amounts of water in use and/or which can be recycled. Suitable polymers include polyolefins, particularly high density polyethylene and polypropylene. The filter is preferably composed of a polymer which can be recycled in the same batch as the threshold and outflow members, and which is preferably the same as the polymer in the threshold and outflow members.

Sediment Control Rolls

The threshold member, filter(s) and outflow member are preferably secured together so that they form a sediment control roll as defined above, i.e. an article that can be transported and placed (i) on top of a substrate, usually the ground, to collect sediment from a sediment-bearing stream of liquid, usually water, which passes through the sediment control roll, or (ii) around a mass of sediment to prevent or reduce removal of the sediment by water flowing towards, over or through the mass of sediment. The threshold member, filter(s) and outflow member can be secured together in any convenient way. For ease of manufacture and for economy, the sediment control roll is preferably made by the process of the third aspect of the present invention.

The sediment control roll is preferably both strong and flexible so that it can be easily handled and will accommodate to uneven substrates, but yet will not be rendered unusable by rough treatment of the kind that is difficult to avoid at construction sites, for example people standing on and vehicles passing over the sediment control roll. Preferably, the sediment control roll, if subjected at room temperature, 70° F., to a test in which a weight of 200 lbs. is applied uniformly to a 1 foot long section of the top of the roll for 20 seconds, and is then removed, the height of the roll, in the section underneath the weight, decreases by at least 25%, often at least 60% or at least 70%, e.g. 60–85%, before the weight is removed, and recovers to at least 60%, particularly at least 75%, of its original height within one hour of the weight being removed. Preferably, the threshold and outflow members are shaped, and have sufficient tensile and flexural strength, to ensure that this is the case, without the need for additional support members. However, the sediment control roll can contain additional support members to provide desired dimensional stability. The invention includes the possibility that the sediment control roll is in a collapsed form which is suitable for storage and transport and which can be converted into usable form, e.g. at the site of use.

It is preferred that all the parts of the sediment control roll are constructed so that the roll does not absorb substantial quantities of water. For example, it is preferred that the roll, when subjected to a test which consists of (i) completely immersing the roll in water for 0.5 hour, (ii) removing the roll from the water, (iii) placing the roll on a horizontal apertured surface, and (iv) leaving the roll to drain for 0.5 hour in still air at 20° C., has a weight after the test which is not more than 1.3 times, preferably not more than 1.1 times, its weight before the test.

It is preferred that the sediment control roll is constructed so that, in a test in which clean water is directed towards the roll at right angles to the threshold member, the roll is capable of passing at least 100, e.g. at least 200, gallons of water, but not more than 400 gallons of water, per square foot per minute of the frontal area of the threshold member (i.e. the area of the threshold member as viewed from the front, e.g. for a cylindrical roll, the length times the diameter of roll). In such a test (and indeed likewise in practice) the structure of the roll is generally such that the volumes of water entering and leaving any particular length of the roll are substantially the same (e.g. do not differ by more than 20%, based on the volume of water entering the roll), since the roll does not function as a pipe to direct liquid to the ends of the roll.

The dry weight of the sediment control roll is preferably such that it can readily be transported and placed in position manually. The weight may be for example 0.5 to 2.5, e.g. 0.65 to 1.8, lb/ft, with a total weight of for example 2 to 20 lb., preferably less than 10 lb.

The tubular sediment control rolls of the present invention can be of any cross-section. Generally, but not necessarily, they have a constant cross section. Rolls having a generally circular cross section are easy to prepare, but rolls having other cross sections, for example oval or polygonal (including, for example, triangular and rectangular, including square) are also possible, and the greater base area of tubes of polygonal cross-section makes them more stable when placed in a generally horizontal position on the ground.

End Sections of Sediment Control Rolls

The end sections of the sediment control rolls of the invention can be completely open, or can be closed by a suitable end member, which may be apertured. The end member may be constructed so that it provides physical support for the roll and reduces the risk of the end of the roll being inadvertently crushed. Alternatively or additionally, the end member may be constructed so that two or more sediment control rolls can be joined together in line to provide an extended sediment control barrier. For example, one or both ends can include a bridging member which fits inside the roll and can be fitted inside an adjacent roll.

Location Members on Sediment Control Rolls

When the sediment control roll is to be placed in a generally horizontal position on the ground, e.g. to collect sediment in run-off from a construction site, it preferably comprises one or more location members which extend away from the sediment control roll and which can be used to secure the roll in place, for example by driving one or more stakes through the location member(s) into the ground and/or by digging a trench in the ground and burying the location member(s) in the trench. Preferably the location member(s) extend beyond the body of the sediment control roll when the roll is viewed in plan from above the roll. Preferably the location member is in the form of a sheet. The sheet maybe an unperforated polymeric film, or it may be composed of polymeric film having apertures therethrough; for example it maybe composed of the same material and/or be an extension of the outflow member.

Assemblies of Sediment Control Rolls

Two or more sediment control rolls can be joined together end-to-end to form a longitudinally extended sediment control assembly. The joints between the sediment control rolls are preferably such that sediment control takes place at the joints as well as between them and/or the sediment-containing liquid cannot pass through the joints. The joints can for example be made by butting the two sediment control rolls together and joining them by means of tapes wires or clamps, which optionally are water-impermeable; and/or by means of a tubular bridging member which fits inside each of the rolls; and/or by melt-bonding, though this is often inconvenient in the field. When the rolls are to be joined at an angle to each other, the end of each roll can be trimmed to the desired angle and/or an angular tubular bridging member can be used. Alternatively, the sediment control roll itself can be constructed to have an angle in it.

Alternatively or additionally, two or more, e.g. six or eight, sediment control rolls can be joined together side-by-side, for example so that there is a single or double layer of sediment control rolls. Such assemblies can include reinforcing members. The resulting assembly can be placed on the ground with the axes of the rolls generally horizontal or generally vertical. Such assemblies are particularly useful when a high volume of sediment-containing liquid is anticipated, or when the objective is to prevent existing masses of sedimentary material from being washed away. All the rolls can be of the same length, or they can be of different lengths. For example, they can be staggered regularly or irregularly to form a stepped assembly. A plurality of such stepped assemblies can for example be placed around a mass of existing sediment, with the axes of the rolls vertical and the longest rolls closest to the existing mass of sediment, and then joined together, thus forming a type of retaining wall.

As part of a manufacturing procedure, such assemblies can be for example made by joining the rolls to each other by melt-bonding, for example through location members and/or by a sheet of apertured material wrapped around the assembly. In the field, the rolls (or manufactured assemblies of rolls) can for example be joined together by means of tapes, wires or clamps, and/or by melt bonding, though melt-bonding is often inconvenient in the field.

Preparation of Sediment Control Rolls

The sediment control rolls on the invention can be prepared in any convenient way. The method of the third aspect of the invention is one satisfactory method for preparing rolls in which the threshold and outflow members comprise overlapping layers of a single piece of apertured sheet material, and the outflow filter and threshold filter, if present, are sandwiched between the overlapping layers. The method can also provide a location member which is part of the same piece of the apertured sheet material.

Figure 4:
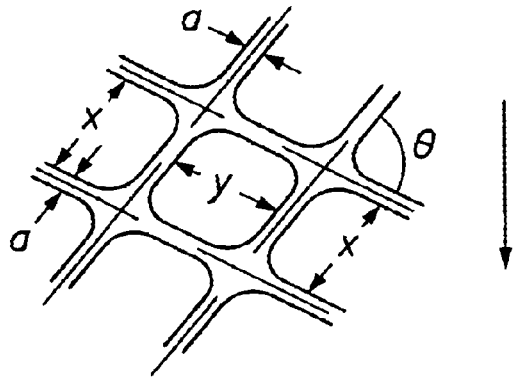
FIG. 4 is a plan view of a part of the exposed surface of a typical threshold member.

In a particular example of this method, a piece of high-density polyethylene netting about 45 in. long is cut from the roll of the netting about 60 in. wide and placed on a flat table. The polymeric strands and the apertures in the netting are as shown in FIG. 4, with the angle Θ being about 75°, a being about 0.062 in, x being about 0.225 in., and y being about 0.215 in. One of the 60 in. edges is inserted into a slot cut into a mandrel which has a diameter of about 5 in. and a length a little over 60 in. The mandrel is rotated, keeping the netting tightly wrapped around the mandrel, until the netting overlaps. An ultrasonic weld head is used to melt bond the overlapping layers along the line of the first overlap. One or more pieces of 200 mesh high-density polyethylene filter sheet of selected size are placed at selected positions on the netting which remains on the table (the size and position of the pieces of filter sheet depending on the on the filter(s) desired in the product), and are melt-bonded to the netting. The mandrel is again rotated, keeping the netting (and bonded filter material) tightly wrapped around the mandrel, until the netting again overlaps. The newly overlapping layers are melt bonded together. The remaining 5 in. of netting still on the table provides the location member. Tubular sleeves having a length of about 10 in. and a diameter slightly less than the inner diameter of the tube are prepared from high-density polyethylene sheet without apertures or from the netting material. The sleeves can be inserted into the ends of the roll so that two or more rolls can be joined together in a line.

The Drawings

Figure 2:
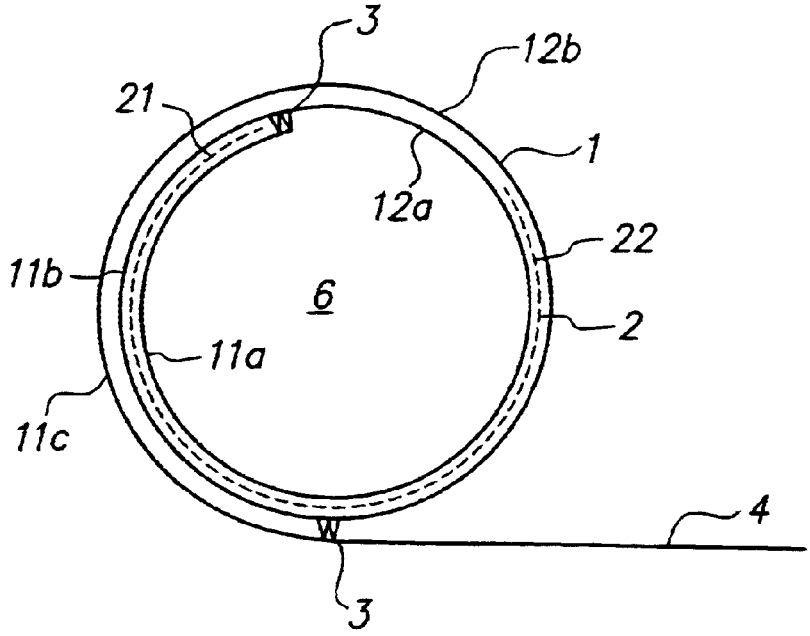
Figure 3:
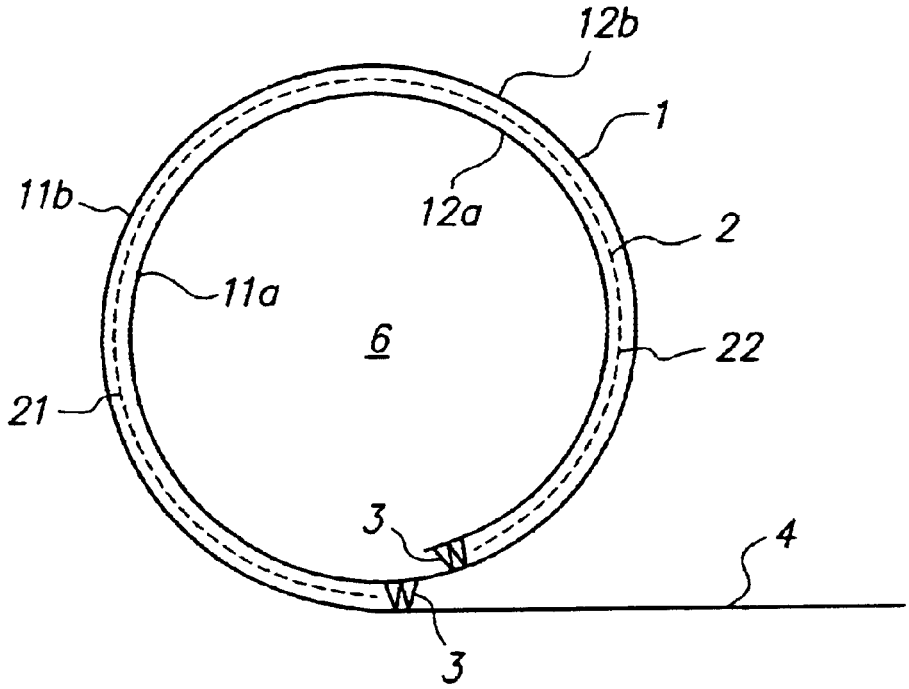

Referring now to the drawings, in which the same reference numerals are used to denote the same or similar components, FIGS. 1, 2 and 3 show different sediment control rolls which can be prepared by the method just described. In each of the Figures, netting material 1 and filter material 2 have been rolled up and melt-bonded together at locations 3, leaving flap 4 of the netting extending as a location member. Overlapping sections 11*a* and 11*b* (and in FIG. 2 also overlapping section 11*c*) of the netting material 1 provide the outflow member, and have outflow filter 21 sandwiched between them. Overlapping sections 12*a* and 12*b* provide the threshold member, and in FIGS. 2 and 3 (but not in FIG. 1) have threshold filter 22 sandwiched between them. In FIG. 2, the threshold filter extends to an upper level which is below the upper level of the outflow filter, thus leaving an upper filter-free section. In FIG. 3, the outflow and threshold filters form a continuous filter around the circumference of the sediment control roll. In each of FIGS. 1–3, sediment collection chamber 6 is enclosed by the threshold and outflow members.

FIG. 4 is a plan view of an example of the polymeric netting that can be used for the threshold and outflow members in the present invention. The netting has been prepared by extrusion in the machine direction shown by the vertical arrow in FIG. 4. The thickness of the polymeric strands is designated a; the acute angle of the parallelogrammatic apertures is designated Θ; the major dimension parallel to the polymeric strands is designated x; and the minor dimension parallel to the polymeric strands is designated y.

Figure 5:
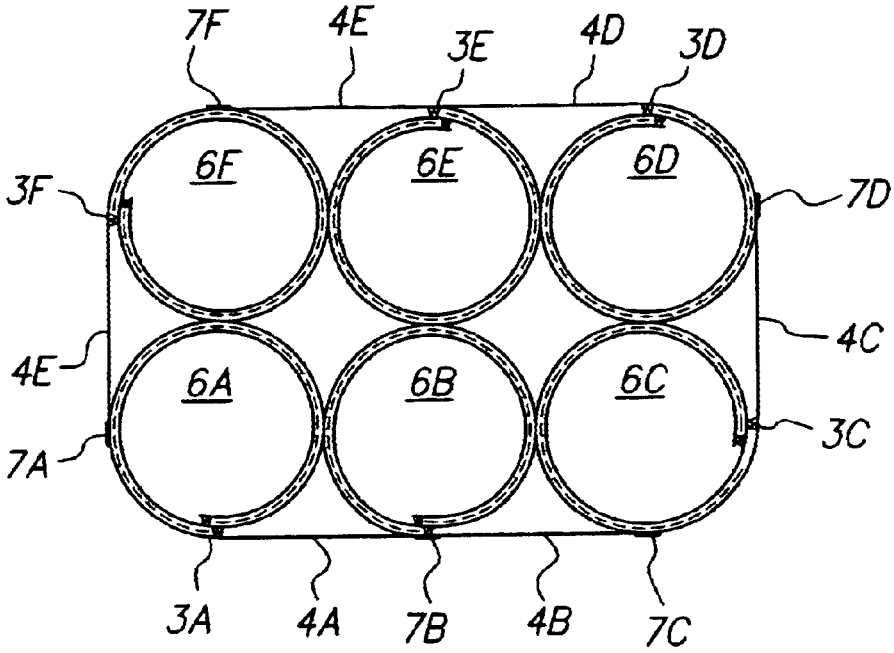
FIGS. 5 and 6 are plan and side views of an assembly comprising six sediment control rolls as shown in FIG. 3.
Figure 6:
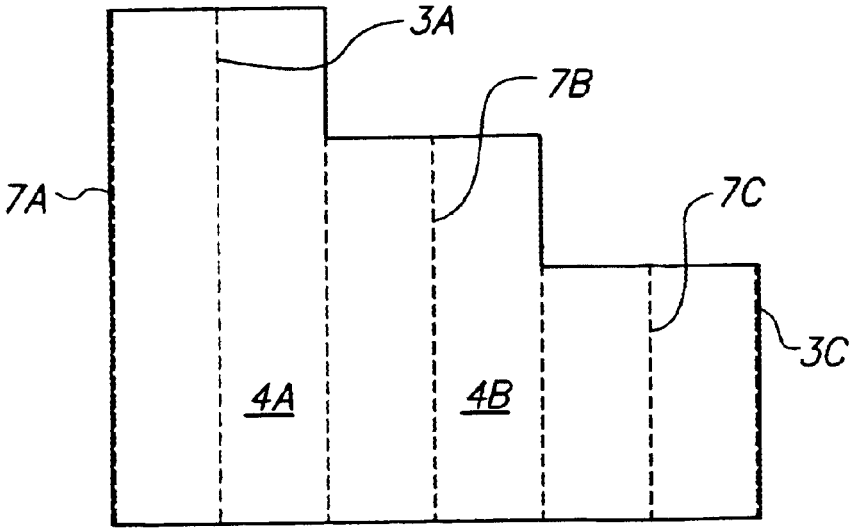

FIGS. 5 and 6 are plan and side views of an assembly made up of six sediment rolls as shown in FIG. 3, but of different lengths. The sediment rolls are joined together by melt-bonding respective location members 4A–4F to the adjacent sediment roll at locations 7A–7F.

What is claimed is:

1. A sediment control roll which comprises 1) an elongate threshold member which comprises a melt-extruded polymeric netting composed of a plurality of polymeric strands which
   (a) define a plurality of substantially identical apertures, each of which has an area of 0.03 to 0.16 $in^2$ and a minimum dimension of 0.015 to 0.4 in., and
   (b) have a solid surface area which is from 25 to 65% of the total area of the netting;
2) an elongate outflow member which comprises a melt-extruded polymeric netting composed of a plurality of polymeric strands which
   (a) define a plurality of substantially identical apertures, each of which has an area of 0.03 to 0.16 $in^2$ and a minimum dimension of 0.015 to 0.4 in., and
   (b) have a solid surface area which is from 25 to 65% of the total area of the netting; and
3) an elongate outflow filter which
   (i) is secured to the outflow member, and
   (ii) has a mesh size of 80 to 500 micron;

the sediment control roll comprising a hollow, elongate sediment collection chamber which (i) lies between the threshold member and the outflow member and (ii) has an unobstructed volume which is at least 80% of the total volume of the sediment control roll.

2. A sediment control roll according to claim 1 wherein the outflow member is composed of two overlapping layers of the melt-extruded polymeric netting and the outflow filter (i) is sandwiched between the two overlapping layers, and (ii) has a substantially uniform thickness of less than 0.5 in.

3. A sediment control roll according to claim 2 wherein the threshold member is composed of two overlapping layers of the melt-extruded polymeric netting.

4. A sediment control roll according to claim 3 wherein the overlapping layers of the threshold member and the outflow member are different parts of a single piece of the polymeric netting.

5. A sediment control roll according to claim 4 which comprises a location member which extends from the outflow member and is another part of the single piece of the polymeric netting.

6. A sediment control roll according to claim 3 which includes a threshold filter which (i) is secured between the overlapping layers of polymeric netting of the threshold member, (ii) has a substantially uniform thickness of less than 0.5 in. and (iii) has a mesh size of 80 to 500 micron.

7. A sediment control roll according to claim 6 wherein the threshold filter extends over the whole of the threshold member.

8. A sediment control roll according to claim 6 wherein the threshold filter extends over only a lower section of the threshold member, the lower section extending from the bottom of the threshold member to an upper level which is at least 45% of the height of the roll.

9. A sediment control roll according to claim 1 wherein the outflow filter extends over the whole of the outflow member.

10. A sediment control roll according to claim 1 wherein the outflow filter extends over only a lower section of the outflow member, the lower section extending from the bottom of the outflow member to an upper level, the upper level being at least 80% of the height of the sediment control roll.

11. A sediment control roll according to claim 1 which, when subjected to a test which consists of (i) completely immersing the roll in water for 0.5 hour,
(ii) removing the roll from the water,
(iii) placing the roll on a horizontal apertured surface, and
(iv) leaving the roll to drain for 0.5 hour in still air at 20° C., has a weight after the test which is not more than 1.1 times, its weight before the test.

12. A sediment roll according to claim 1 which, when subjected to a test in which clean water is directed towards the roll at right angles to the threshold member, the roll is capable of passing at least 100 gallons of water, but not more than 400 gallons of water, per square foot per minute of the frontal area of the threshold member, and the volumes of water entering and leaving any particular length of the roll are substantially the same.

13. A sediment roll according to claim 1 which, when subjected at 70° F. to a test in which a weight of 200 lbs. is applied uniformly to a 1 foot long section of the top of the roll for 20 seconds, and is then removed, the height of the roll, in the section underneath the weight, decreases by at least 60% before the weight is removed, and recovers to at least at least 75% of its original height within one hour of the weight being removed.

14. A sediment control assembly which comprises a plurality of sediment control rolls as defined in claim 1.

15. A sediment control assembly according to claim 14, wherein the sediment control rolls are joined together end-to-end.

16. A sediment control assembly according to claim 14 wherein the sediment control are joined together side-by-side.

17. A method of reducing sediment runoff from a construction site, the method rising placing a plurality of sediment control rolls as defined in claim 1 around the construction site.

18. A sediment control roll which comprises 1) an elongate threshold member which is composed of two overlapping layers of polymeric netting;
2) an elongate outflow member which is composed of two overlapping layers of polymeric netting;
3) a location member which extends from the outflow member;

the threshold member, the outflow member and the location member being different parts of a single piece of melt-extruded polymeric netting composed of a plurality of polymeric strands which (a) define a plurality of substantially identical apertures, each of which has an area of 0.03 to 0.16 $in^2$; and
   (b) have a solid surface area which is from 25 to 65% of the total area of the netting; and
4) an elongate outflow filter which
   (i) is secured between the overlapping layers of the outflow member and
   (ii) has a mesh size of 80 to 500 micron;

the sediment control roll comprising a hollow, elongate sediment collection chamber which (i) lies between the threshold member and the outflow member and (ii) has an unobstructed volume which is at least 80% of the total volume of the sediment control roll.

19. A sediment control roll according to claim 18 wherein the outflow filter extends over the whole of the outflow member.

20. A sediment control roll according to claim 18 which includes a threshold filter which is secured between the overlapping layers of polymeric netting of the threshold member and which has a mesh size of 80 to 500 micron.

21. A sediment control roll according to claim 20 wherein the threshold filter extends over the whole of the threshold member.

22. A sediment control roll according to claim 20 wherein the threshold filter extends over only a lower section of the threshold member, the lower section extending from the bottom of the threshold member to an upper level which is at least 45% of the height of the roll.

23. A sediment control roll according to claim 18 wherein the outflow filter extends over only a lower section of the outflow member, the lower section extending from the bottom of the outflow member to an upper level, the upper level being at least 80% of the height of the sediment control roll.

24. A sediment control roll according to claim 18 which, when subjected to a test which consists of (i) completely immersing the roll in water for 0.5 hour, (ii) removing the roll from the water, (iii) placing the roll on a horizontal apertured surface, and (iv) leaving the roll to drain for 0.5 hour in still air at 20° C., has a weight after the test which is not more than 1.1 times, its weight before the test.

25. A sediment roll according to claim 18 which, when subjected to a test in which clean water is directed towards the roll at right angles to the threshold member, the roll is capable of passing at least 100 gallons of water, but not more than 400 gallons of water, per square foot per minute of the frontal area of the threshold member, and the volumes of water entering and leaving any particular length of the roll are substantially the same.

26. A sediment roll according to claim 18 which, when subjected at 70° F. to a test in which a weight of 200 lbs. is applied uniformly to a 1 foot long section of the top of the roll for 20 seconds, and is then removed, the height of the roll, in the section underneath the weight, decreases by at least 60% before the weight is removed, and recovers to at least at least 75% of its original height within one hour of the weight being removed.

* * * * *